US005893946A

United States Patent [19]

Landis

[11] Patent Number: 5,893,946

[45] **Date of Patent: *Apr. 13, 1999**

[54] COMBUSTIBLE CARBONACEOUS COMPOSITIONS AND METHODS

[75] Inventor: Charles R. Landis, Lake in the Hills, Ill.

[73] Assignee: Amcol International Corporation, Arlington Heights, Ill.

[ * ] Notice: This patent is subject to a terminal disclaimer.

[21] Appl. No.: 08/852,678

[22] Filed: May 7, 1997

Related U.S. Application Data

[63] Continuation-in-part of application No. 08/759,087, Nov. 29, 1996, Pat. No. 5,688,313, which is a continuation-in-part of application No. 08/668,245, Jun. 21, 1996, Pat. No. 5,695,554.

[51] Int. Cl.[6] ..... B22C 1/00; B22C 9/00; B22C 9/02

[52] U.S. Cl. ..... 106/38.2; 106/38.22; 106/38.27; 106/38.28; 106/38.9; 502/413; 502/416; 164/47; 164/138; 164/529; 95/141; 44/550; 44/551; 44/591; 44/592; 44/641

[58] Field of Search ..... 44/550, 551, 591, 44/592, 641; 106/38.2, 38.28, 38.22, 38.27, 38.9; 502/413, 416; 164/529, 47, 138; 95/141

[56] References Cited

U.S. PATENT DOCUMENTS

| | | | |
|---|---|---|---|
| 1,590,706 | 6/1926 | Spencer . | |
| 1,618,028 | 2/1927 | Wagel . | |
| 2,822,251 | 2/1958 | Swinehart et al. | 44/41 |
| 2,830,342 | 4/1958 | Meyers et al. | 22/193 |
| 2,830,913 | 4/1958 | Meyers et al. | 106/38.9 |
| 3,023,113 | 2/1962 | Barlow | 106/38.8 |
| 3,089,760 | 5/1963 | Jafee | 44/41 |
| 3,304,161 | 2/1967 | McGoff | 44/17 |
| 3,385,681 | 5/1968 | Mennen | 44/17 |
| 3,445,251 | 5/1969 | Nevins | 106/38.3 |
| 3,485,600 | 12/1969 | Robertson | 44/24 |
| 3,689,234 | 9/1972 | Onozawa | 44/17 |
| 3,709,700 | 1/1973 | Ross | 44/6 |
| 3,832,191 | 8/1974 | Bolding et al. | 106/38.3 |
| 3,938,578 | 2/1976 | Epstein et al. | 164/16 |
| 3,941,868 | 3/1976 | Riester | 423/210 |
| 4,002,722 | 1/1977 | Suzuki et al. | 423/238 |
| 4,034,794 | 7/1977 | Gebler et al. | 106/38.28 |
| 4,035,157 | 7/1977 | Riester | 23/277 C |
| 4,167,398 | 9/1979 | Hughes et al. | 44/17 |
| 4,230,602 | 10/1980 | Bowen et al. | 252/421 |
| 4,419,185 | 12/1983 | Bowen et al. | 201/4 |
| 4,505,750 | 3/1985 | Cowan | 106/38.35 |
| 4,615,712 | 10/1986 | Wen | 44/10 R |
| 4,787,914 | 11/1988 | Crace | 44/16 A |
| 4,946,647 | 8/1990 | Rohatgi et al. | 420/528 |
| 5,026,416 | 6/1991 | Alexander | 71/24 |
| 5,034,045 | 7/1991 | Alexander | 71/24 |
| 5,094,289 | 3/1992 | Gentry | 164/529 |
| 5,215,143 | 6/1993 | Gentry | 164/529 |
| 5,221,290 | 6/1993 | Dell | 44/554 |
| 5,275,114 | 1/1994 | Hughes | 106/38.3 |
| 5,688,313 | 11/1997 | Landis | 106/38.2 |
| 5,695,554 | 12/1997 | Landis | 106/38.2 |

FOREIGN PATENT DOCUMENTS

| | | |
|---|---|---|
| 843443 | 6/1970 | Canada . |
| 0 564 024 A1 | 10/1993 | European Pat. Off. . |
| 29 16 911 A1 | 10/1980 | Germany . |
| 51-045101 | 4/1976 | Japan . |
| 374365 | of 1900 | U.S.S.R. . |
| 1184908 | 3/1970 | United Kingdom . |

*Primary Examiner*—Paul Marcantoni
*Attorney, Agent, or Firm*—Marshall, O'Toole, Gerstein, Murray & Borun

[57] ABSTRACT

A combustible carbonaceous composition and method of making a charcoal briquette wherein a finely divided carbonaceous material is combined with an activated carbon and/or an activated graphite (which may be formed in-situ during pyrolysis of the composition by reacting a humic-containing ore with a low VOC-containing carbon and/or graphite). The combustible carbonaceous composition is present in the briquette composition in an amount of about 65% to about 99.9% by weight; a binder is included in the composition in an amount of about 1% to about 15% by weight when forming a charcoal briquette or an igniter log; and the activated carbon and/or activated graphite is present in an amount of about 0.1% to about 20% by weight. The activated carbon and/or activated graphite absorbs most of the VOCs entitled from the combustible carbonaceous material, thereby preventing the VOCs from escaping to the atmosphere.

24 Claims, No Drawings

COMBUSTIBLE CARBONACEOUS COMPOSITIONS AND METHODS

CROSS-REFERENCE TO RELATED APPLICATIONS

This application is a continuation-in-part of U.S. application Ser. No. 08/759,087 filed Nov. 29, 1996 now U.S. Pat. No. 5,688,313 which is a continuation-in-part of U.S. application Ser. No. 08/668,245 filed Jun. 21, 1996 now U.S. Pat. No. 5,695,554.

FIELD OF THE INVENTION

The present invention is directed to a combustible carbonaceous composition, such as a charcoal briquette, made from (a) one or more combustible carbonaceous materials, and (b) activated carbon or activated graphite, and/or low VOC carbon or low VOC graphite together with a humic-containing ore capable of forming activated carbon or activated graphite in-situ. The composition containing the combustible carbonaceous material, and activated carbon and/or activated graphite can be used as a ground mixture, such as in a coal-burning furnace or steam generator, or can be compressed under high pressure with a suitable binder into a desired briquette shape, as known in the art, and the activated carbon/graphite absorbs volatile organic compounds resulting from heating the combustible carbonaceous materials.

BACKGROUND OF THE INVENTION AND PRIOR ART

Charcoal briquettes are commonly used in the United States as a source of heat and flavor for outdoor cooking on a barbecue grill or hibachi. The charcoal briquettes are formed from a combination of a combustible carbonaceous material such as charcoal, peat, coal, or other combustible, hydrocarbon-containing carbon source together with a binder, such as corn starch, a non-toxic polymeric material or the like, and compressed under high pressure into briquettes for use as a barbecue fuel. After the composition is formed into briquettes, the briquettes are dried to remove essentially all of the moisture so that the briquettes are capable of ignition. Exemplary of various charcoal briquette compositions and methods of manufacturing charcoal briquettes include the following U.S. Pat. Nos. Dell 5,221,290; Spencer 1,590,706; Wagel 1,618,029; Jaffe 3,089,760; McGoff 3,304,161; Ross 3,709,700; Robertson 3,485,600; Mennen 3,385,681; Onozawa 3,689,234; Swinehart, et al. 2,822,251; Hughes, et al. 4,167,398; and Crace 4,787,914, hereby incorporated by reference.

Surprisingly, it has been found that by including (a) activated carbon and/or activated graphite as a charcoal briquette composition additive, and/or by including (b) non-activated or incompletely activated carbon and/or graphite and a humic acid-containing ore or a humic acid salt-containing ore, oxidation of the carbon and/or graphite source occurs in-situ during the pyrolysis, or heating to a temperature of at least about 450° F., of the charcoal briquette composition to reduce VOCs escaping from the pyrolyzing composition to the atmosphere. The activated carbon and/or activated graphite, initially added in activated form to the combustible carbonaceous composition or added to the composition in the form of reactants capable of activating carbon and/or graphite in-situ, sorbs unexpectedly high amounts of volatile organic compounds (VOCs) that are volatilized from the combustible carbonaceous material—thereby eliminating or reducing the need for VOC-elimination treatment of the gases formed during heating of the carbonaceous material. Such VOC reduction resulting from activated carbon and/or activated graphite formed in-situ is quite unexpected so long as the carbon and/or graphite added to the combustible carbonaceous material for activation in-situ has a low total organic volatiles content (low VOC), at 1800° F. and 1 atmosphere (750 mm Hg) pressure, hereby defined as less than about 10 mg/g, preferably less than about 1 mg/g, more preferably less than about 0.5 mg/g, and most preferably less than about 0.3 mg/g volatiles, at 1800° F. and 1 atmosphere (760 mm Hg) pressure.

SUMMARY OF THE INVENTION

In brief, the present invention is directed to a combustible, low VOC-emitting combustible carbonaceous composition containing activated graphite and/or activated carbon, such as in the form of a carbonaceous briquette, and method of making the briquette wherein finely divided activated carbon or activated graphite particles are combined with particles of a combustible carbonaceous material. Optionally, the composition includes a binder, and the combined materials are formed into a desired briquette shape under high pressure. The combustible carbonaceous material is present in the briquette composition of the present invention in an amount of about 65% to about 96% by weight; the binder is present in an amount of about 1% to about 15% by weight; and the activated carbon and/or activated graphite (or reactants capable of low VOC carbon and/or low VOC graphite activation during heating) is present in an amount of about 0.1% to about 20% by weight, preferably about 2% to about 10% by weight of the composition.

If a binder is not needed in the composition, e.g., when the composition is used as a fuel for furnaces or in steam-generating electrical utility plants, the composition comprises about 80% to about 99.9% by weight of a combustible carbonaceous material, and about 0.1% to about 20% activated carbon and/or activated graphite (or about 0.1% to about 20% by weight components capable of forming activated carbon and/or activated graphite, in-situ, during heating of the carbonaceous material). The activated carbon and/or activated graphite absorbs most of the volatile organic compounds emitted by the combustible carbonaceous material during heating such that a surprisingly low concentration of VOCs are emitted to the atmosphere.

In one embodiment, the present invention is directed to an activated carbon and/or activated graphite-containing charcoal briquette composition and method of producing heat by pyrolyzing charcoal briquettes that include a combustible carbonaceous material, a binder for the combustible carbonaceous material, and the activated carbon and/or activated graphite. In another embodiment, instead of or in addition to adding activated carbon and/or activated graphite to the charcoal briquette composition, components capable of reaction, in-situ, to form activated carbon and/or activated graphite are added. Preferably, the reactive components are low VOC carbon and/or low VOC graphite, hereby defined as having a total volatile organic content (VOC) less than about 10 mg/g at 1800° F. and 1 atmosphere (760 mm Hg) pressure, preferably less than about 1 mg/g, more preferably less than about 0.5 mg/g, most preferably less than about 0.3 mg/g; and a humic acid-containing ore and/or a humic acid salt-containing ore, capable of forming activated carbon and/or activated graphite, in-situ, during pyrolysis of the charcoal briquette composition.

In the first embodiment, the charcoal briquette composition additive comprises activated carbon and/or activated graphite. In the second embodiment, the charcoal briquette composition additive comprises a non-activated or incompletely activated low VOC carbon and/or low VOC graphite, and a humic acid-containing and/or a humic acid salt-containing ore (hereinafter referred to separately or in combination as "humic-containing ore"). The combination of low VOC carbon and/or low VOC graphite and the humic-containing ore react in-situ when the charcoal briquette composition is heated to temperatures of about 450° F. or above to activate or further activate the carbon and/or graphite.

The activated carbon and/or activated graphite additive, with or without low VOC carbon and/or low VOC graphite and a humic-containing ore for activation of the carbon and/or graphite in-situ during the pyrolysis process, absorb and/or adsorb (sorb) gaseous volatile organic compounds (VOCs) emitted from the combustible carbonaceous material during pyrolysis, so that the VOC gases are held by the activated carbon and/or activated graphite to reduce VOC emissions, so long as the carbon and/or graphite activated in-situ initially has a low total organic volatiles content at 1800° F. and 1 atmosphere (760 mm Hg) pressure (less than about 10 mg/g, preferably less than about 1 mg/g, more preferably less than about 0.5 mg/g, and most preferably less than about 0.3 mg/g). To achieve the full advantage of the in-situ activation embodiment of the present invention, it has been found that the carbon and/or graphite additive should have a surface area of at least about 15 $m^2$/gram, preferably at least about 20 $m^2$/gram, so that the carbon and/or graphite is sufficiently activated in-situ to at least about 200 $m^2$/g, preferably at least about 400 $m^2$/g for relatively efficient sorption (about 10% to about 35%) of the VOCs generated during heating and/or pyrolysis of the combustible carbonaceous material.

Accordingly, one aspect of the present invention is to provide a combustible briquette containing a combustible carbonaceous material, that includes a binder, and activated carbon and/or activated graphite to provide a charcoal briquette that has surprisingly low VOC emissions during heating and pyrolysis.

Another aspect of the present invention is to provide an additive for combustible carbonaceous materials selected from the group consisting of activated carbon; activated graphite; and mixtures thereof that is activated before being added to the combustible carbonaceous material. The activated carbon and/or activated graphite is added to the combustible carbonaceous material composition in combined amounts of about 0.1% to about 20%, based on the total dry weight of the composition. Alternatively, the activated carbon and/or activated graphite can be formed in-situ during heating of the combustible carbonaceous material from a combination of carbon and/or graphite and a humic-containing ore. Depending on the degree of oxidation of the humic-containing ore, preferably, an amount of humic-containing ore is added to the combustible carbonaceous material such that the humic-containing ore is capable of oxidizing (activating) the carbon or graphite additive to a surface area of at least about 200 $m^2$/g, preferably to at least about 400 $m^2$/g.

Still another aspect of the present invention is to provide a combustible carbonaceous material additive comprising activated carbon and/or activated graphite together with components capable of forming activated carbon and/or activated graphite in-situ during combustion of the combustible carbonaceous material.

Another aspect of the present invention is to provide a combustible carbonaceous material additive composition, and method of heating a combustible carbonaceous material, that provides activated carbon and/or activated graphite, in-situ, for absorption of gaseous organic compounds, such as benzene, that are volatilized from the combustible carbonaceous material during the pyrolysis of the combustible carbonaceous material.

Another aspect of the present invention is to provide a combustible carbonaceous composition that includes one or more combustible carbonaceous materials in an amount of about 65% to about 96% by weight; a binder for the combustible carbonaceous material, such as corn starch and/or a non-toxic polymeric binder, in an amount of about 1% to about 15% by weight, based on the dry weight of the composition; activated carbon and/or activated graphite in an amount of about 0.1% to about 20% by weight based on the total dry weight of the composition and/or a ground humic-containing ore, such as oxidized lignite, e.g., FLOCARB®, sold by this Assignee, in an amount of about 0.1% to about 10% by weight, preferably about 0.1% to about 5% by weight, based on the dry weight of the composition, together with carbon, graphite or a combination thereof in an amount of about 0.1% to about 10% by weight, preferably about 0.1% to about 5% by weight, in a ratio of about 5/95 to 95/5 by weight ore/carbon and/or graphite, more preferably a ratio of about 15–95% humic-containing ore to 85–5% low VOC carbon and/or graphite, based on the total weight of humic-containing ore, low VOC carbon and graphite. The carbon and/or graphite, added with a humic-containing ore, should have a low VOC content (herein defined as carbon or graphite having below about 1 mg/g, more preferably below about 10 mg/g VOCs at 1800° F. and 1 atmosphere (760 mm Hg) pressure, preferably below about 1 mg/g, more preferably below about 0.5 mg/g, most preferably below about 0.3 mg/g). The above and other aspects and advantages of the present invention will become more apparent from the following detailed description of the preferred embodiments of the invention taken in conjunction with the drawings.

DETAILED DESCRIPTION OF THE PREFERRED EMBODIMENTS

The present invention is directed to a composition comprising activated carbon and/or an activated graphite and a combustible carbonaceous material that is capable of pyrolysis to provide heat. Suitable examples of uses for the composition include charcoal briquettes; igniter logs, e.g., for fireplaces; fuel for use in industrial and residential furnaces and for use by utility companies in producing electricity, and the like. In one embodiment, the composition comprises one or more combustible carbonaceous materials and a combination of a humic-containing ore and a low VOC-containing carbon or graphite. The composition can be in the form of a free-flowing mixture of combustible carbonaceous materials, carbon and/or graphite, and a humic-containing ore; or a mixture of combustible carbonaceous materials and activated carbon and/or activated graphite; or mixtures thereof.

In another embodiment, the composition includes a binder so that the composition can be molded into a desired shape. One or more binders are mixed with the combustible carbonaceous material when manufacturing charcoal briquettes and igniter logs to maintain the carbonaceous material in a predetermined configuration.

The activated carbon and/or activated graphite can be added to the combustible carbonaceous material as such, or may be generated in-situ during the pyrolysis of the composition, e.g., charcoal briquette, by adding a low VOC carbon or graphite to the composition together with a material selected from the group consisting of humic acid; and any humic acid-containing ore or humic acid salt-containing ore, particularly lignite, and oxidized lignite or leonardite. The preferred source of humic acid is a humic acid-containing ore, such as lignite or leonardite, particularly oxidized lignite, and/or oxidized leonardite, as described in this Assignee's U.S. Pat. Nos. 5,034,045 and 5,026,416, hereby incorporated by reference.

Activated carbon and/or activated graphite absorb and/or adsorb volatile organic compounds (VOCs) that are volatilized during the pyrolysis of the combustible carbonaceous material of the composition. In one embodiment, carbon and/or graphite and a humic-containing ore are included with the activated carbon and/or graphite, whereby the combination of carbon and/or graphite and the humic-containing ore react in-situ during pyrolysis of the composition, at temperatures above about 450° F., to activate the carbon and/or graphite so that volatile organic compounds (VOCs) that are volatilized during composition pyrolysis are more completely sorbed (absorbed and/or adsorbed) by the activated carbon/graphite, activated in-situ. In accordance with the present invention, the carbon and/or graphite added to the combustible carbonaceous material for activation in-situ during pyrolysis of the combustible carbonaceous material should have a total organic volatiles content, at 1800° F., of less than about 10 mg/g, preferably less than about 1 mg/g, more preferably less than about 0.5 mg/g, and most preferably less than about 0.3 mg/g.

Any binder ordinarily used to bind finely divided carbonaceous materials e.g., 37 μm to about 4500 μm in size, can be used with the carbonaceous compositions disclosed herein to enable the carbonaceous materials to retain a predetermined or desired briquette or igniter log shape without substantial breakage during handling. Such binders generally are present in amounts of about 1% to about 15% based on the total dry weight of the combustible carbonaceous material composition and may be adjusted to whatever amounts that will produce the desired strength, hardness or other desirable physical properties. Some of the binders which can be used to bind the combustible carbonaceous materials of this invention into a strong shape, such as a charcoal briquette shape, include bentonites, other clays, starches, sugars, cereals, core oils, sodium silicates, thermoplastic and thermosetting resins, vapor-curing binders, chemically-curing binders, heat-curing binders, pitches, resins, cements and various other binders known in the art.

The combustible carbonaceous materials of the present invention include about 65% to about 96% by weight of a suitable combustible carbonaceous material, such as powdered charcoal, powdered anthracite coal or powdered coke. Other suitable combustible carbonaceous materials include bituminous coal, lignite, oxidized lignite, leonardite, oxidized leonardite, coke breeze, petroleum coke, metallurgical coke, coal screenings, and the like. In the briquette embodiment of the present invention, the combustible carbonaceous materials are sufficiently finely divided to be compressed together under high pressure of about 10,000 to about 20,000 psi together with a binder and activated carbon and/or activated graphite to form a cohesive mass in a desired briquette shape. The resulting briquettes should have sufficient dry strength for handling and transportation without significant breakage, e.g., less than 10% of the briquettes being broken in normal handling and transportation.

In accordance with one embodiment of the charcoal briquette composition and method of the present invention, the combustible carbonaceous particles are bound together with a binder, for example a pre-cooked hydrated organic binder/water-swellable clay paste, disclosed in U.S. Pat. No. 5,221,290, hereby incorporated by reference.

The water-swellable clays used in the clay binder embodiment of the charcoal briquette compositions and methods of the present invention include reactive hydroxyl groups that are more available for reaction with a hydroxyl-reactive substituent of organic binders when the clay is in the hydrated state. Accordingly, the organic binders useful in this embodiment of the present invention include any organic binder that is at least partially soluble in water (at least 10% by weight solubility at one atmosphere pressure and 25° C.). A wide range of organic binders that are soluble in water and include a substituant reactive with the water-swellable clay hydroxyl groups include all of the starches, such as corn starch, wheat starch, barley starch, sorghum starch, sago palm starch, tapioca starch, potato starch, rice starch, and arrowroot starch, each including reactive hydroxyl groups; hydroxy alkyl celluloses, such as hydroxy methyl cellulose, hydroxy propyl cellulose, hydroxy propyl methyl cellulose, hydroxy ethyl cellulose, hydroxy propyl ethyl cellulose; the carboxy alkyl celluloses, such as carboxy methyl cellulose, carboxy ethyl cellulose, carboxy propyl methyl cellulose, and the like, each including reactive carboxyl groups; the polysaccharides, such as dextrin, dextrose, glucose, lactose, maltose, sucrose and the like; the hydroxyl-reactive gums such as gum arabic, gum tragacanth, guar gum, gum karaga, locust bean gum, okra gum, and the like; and any other hydroxyl-reactive organic adhesive materials that are non-toxic when pyrolyzed.

In the above-described charcoal briquette embodiment, the organic binder and the water-swellable clay are slurried in water to a total solids content in the slurry in the range of about 10% to about 50% by weight, dry solids basis, with a weight ratio of organic binder to water-swellable clay in the range of about 1.5 to about 3.0 to 1.

It should be understood that the present disclosure has been made only by way of preferred embodiments and the numerous changes in details or construction, combination and arrangement of parts can be resorted to without departing from the spirit and scope of the invention as hereunder claimed.

What is claimed is:

1. A combustible carbonaceous composition comprising a carbonaceous material in an amount of about 65% to about 99.9% by weight; and an activated carbon material selected from the group consisting of activated carbon, activated graphite, and mixtures thereof in an amount of about 0.1% to about 20% by weight.

2. The composition of claim 1, wherein the activated carbon material is formed in-situ during pyrolysis of the composition by including in the composition a finely divided humic-containing ore together with carbon or graphite.

3. The composition of claim 2, wherein the carbon material has a VOC content, at 1800° F. and 760 mm Hg pressure, of less than about 10 mg/g.

4. The composition of claim 1, further including a binder for the combustible carbonaceous material, in an amount of about 1% to about 15% by weight of the composition.

5. The composition of claim 4, wherein the composition is in briquette form by compressing the composition under pressure sufficient to provide sufficient strength for handling and transportation.

6. The composition of claim 4, wherein the binder is a combination of a water-swellable clay and an organic binder selected from the group consisting of starch, a hydroxyl alkyl cellulose, dextrin, a gum, polyvinyl alcohol, a carboxy alkyl cellulose, metal salts of a carboxy alkyl cellulose, and a polysaccharide.

7. The composition of claim 4, wherein the combustible carbonaceous material is selected from the group consisting of charcoal, anthracite coal, bituminous coal, coke, coke breeze, lignite, oxidized lignite, leonardite, oxidized leonardite, and mixtures thereof.

8. The composition of claim 6, wherein the organic binder is a starch selected from the group consisting of corn starch, wheat starch, barley starch, sorghum starch, sago palm starch, tapioca starch, potato starch, rice starch, arrowroot starch, and mixtures thereof.

9. The composition of claim 6, wherein the organic binder is a gum selected from the group consisting of gum arabic; gum tragacanth; guar gum; gum karaga; locust bean gum; agar; okra gum; and mixtures thereof.

10. The composition of claim 6, wherein the water-swellable clay is a dioctahedral smectite, a trioctrahedral smectite, or a mixture thereof.

11. The composition of claim 10, wherein the clay is selected from the group consisting of montmorillonite, beidellite, nontronite, hectorite, saponite, and mixtures thereof.

12. The composition of claim 11, wherein the water-swellable clay is a montmorillonite clay.

13. The composition of claim 12, wherein the clay is a bentonite clay selected from the group consisting of sodium bentonite, potassium bentonite, lithium bentonite, ammonium bentonite, calcium bentonite, magnesium bentonite and mixtures thereof.

14. A method of manufacturing a combustible carbonaceous briquette comprising:

mixing about 1% to about 15% by weight binder, about 0.1% to about 20% of an activated carbon material selected from the group consisting of a activated carbon, activated graphite, and mixtures thereof and about 65% to about 96% by weight of particles of a combustible carbonaceous material to form a briquette composition; and compressing the briquette composition under pressure sufficient to form a briquette having sufficient strength for handling and transport.

15. The method of claim 14, wherein the activated carbon material is formed in-situ during pyrolysis of the briquette by including in the composition a finely divided humic-containing ore together with a carbon material selected from the group consisting of carbon, graphite, and mixtures thereof.

16. The method of claim 15, wherein the carbon material has a VOC content, at 1800° F. and 760 mm Hg pressure, of less than about 10 mg/g.

17. The method of claim 14, wherein the binder is a combination of a water-swellable clay and an organic binder selected from the group consisting of starch, a hydroxyl alkyl cellulose, dextrin, a gum, polyvinyl alcohol, a carboxy alkyl cellulose, metal salts of a carboxy alkyl cellulose, and a polysaccharide.

18. The method of claim 14, wherein the combustible carbonaceous material is selected from the group consisting of charcoal, anthracite coal, bituminous coal, coke, coke breeze, lignite, oxidized lignite, leonardite, oxidized leonardite, and mixtures thereof.

19. The method of claim 17, wherein the water-swellable clay is a dioctahedral smectite, a trioctrahedral smectite, or a mixture thereof.

20. The method of claim 19, wherein the clay is selected from the group consisting of montmorillonite, beidellite, nontronite, hectorite, saponite, and mixtures thereof.

21. The method of claim 20, wherein the water-swellable clay is a montmorillonite clay.

22. The composition of claim 21, wherein the clay is a bentonite clay selected from the group consisting of sodium bentonite, potassium bentonite, lithium bentonite, ammonium bentonite, calcium bentonite, magnesium bentonite and mixtures thereof.

23. A method of generating heat comprising pyrolyzing the composition of claim 1.

24. A combustible briquette made by the method of claim 14.

* * * * *